US008156702B2

(12) United States Patent
Kim

(10) Patent No.: US 8,156,702 B2
(45) Date of Patent: Apr. 17, 2012

(54) WATERPROOF CEILING

(76) Inventor: Won Keol Kim, Goyang-si (KR)

( * ) Notice: Subject to any disclaimer, the term of this patent is extended or adjusted under 35 U.S.C. 154(b) by 296 days.

(21) Appl. No.: 12/493,553

(22) Filed: Jun. 29, 2009

(65) Prior Publication Data

US 2010/0281800 A1 Nov. 11, 2010

(30) Foreign Application Priority Data

May 11, 2009 (KR) ..... 10-2009-0040637

(51) Int. Cl.
*E04B 1/70* (2006.01)

(52) U.S. Cl. ..... 52/302.3; 52/302.1

(58) Field of Classification Search ..... 52/22, 302.1, 52/302.3, 508
See application file for complete search history.

(56) References Cited

U.S. PATENT DOCUMENTS 4,817,343 A * 4/1989 Rutledge ..... 52/22
5,207,035 A * 5/1993 Fowler ..... 52/22
6,640,502 B2 * 11/2003 Mueller ..... 52/22

FOREIGN PATENT DOCUMENTS

JP 2006-016846 A * 1/2006
JP 2006-057375 A * 3/2006

* cited by examiner

*Primary Examiner* — Jeanette E Chapman
*Assistant Examiner* — Daniel Kenny
(74) *Attorney, Agent, or Firm* — Lucas & Mercanti, LLP

(57) ABSTRACT

Disclosed herein is a waterproof ceiling. The waterproof ceiling includes a hanger unit secured at an upper end thereof to an existing ceiling to support a load on a lower end. A carrying channel is connected to the lower end of the hanger unit so as to be at right angles with the hanger unit. A drain module bar is connected and secured to a predetermined portion on the carrying channel and forms a predetermined angle with the ground to create a flow passage for leaked water. A waterproof panel is fitted to each of both sides of the drain module bar, thus closing a space between drain module bars. A water collecting pipe is provided horizontally on an end of the drain module bar, thus collecting the leaked water and discharging the water to the outside.

15 Claims, 14 Drawing Sheets

[Figure 6]
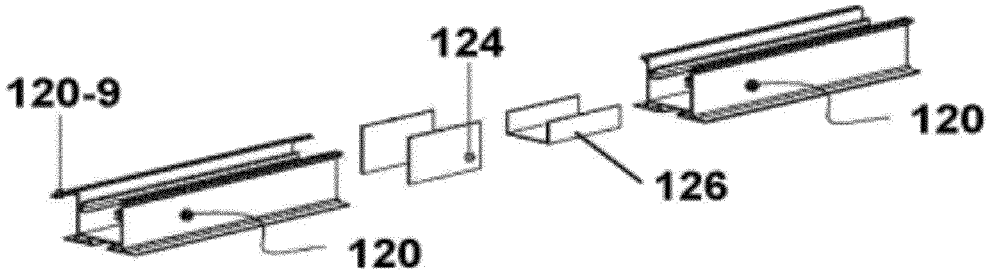

[Figure 7]
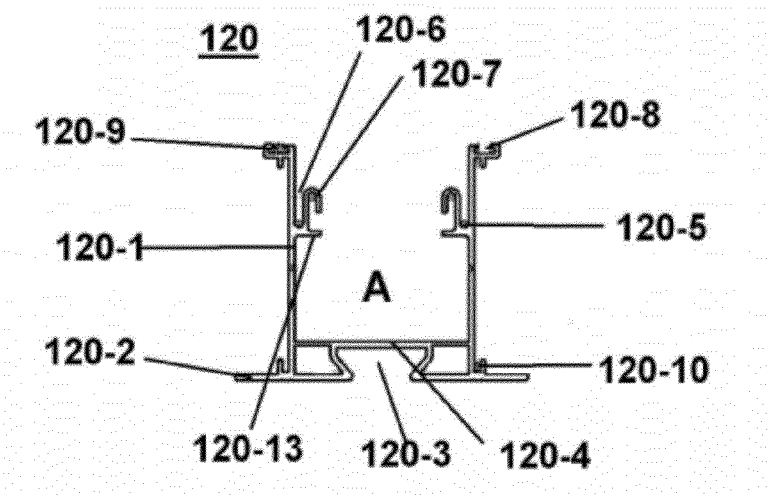
[Figure 8]
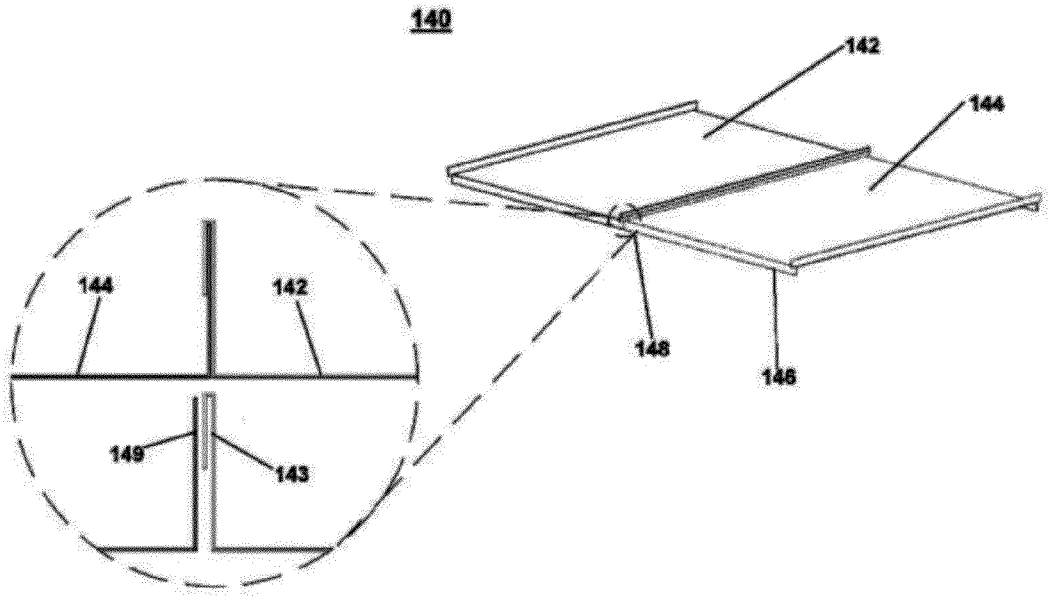

[Figure 14]
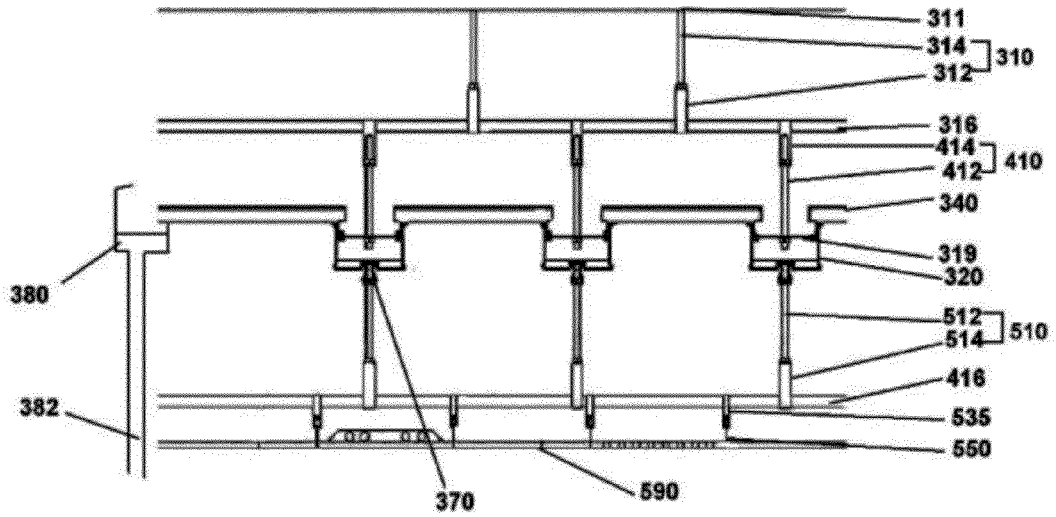
[Figure 15]
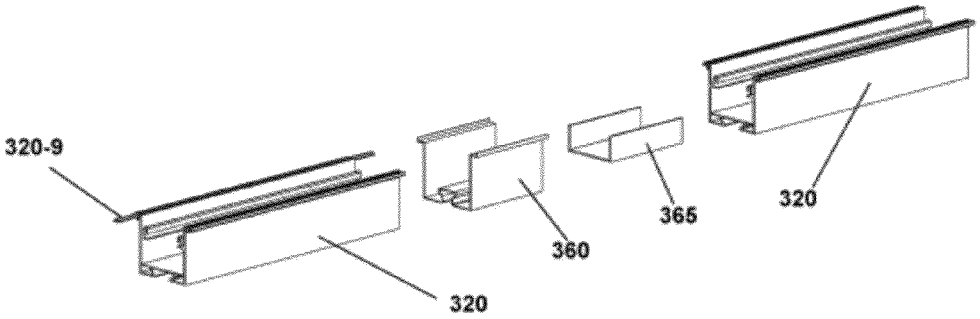

[Figure 16]
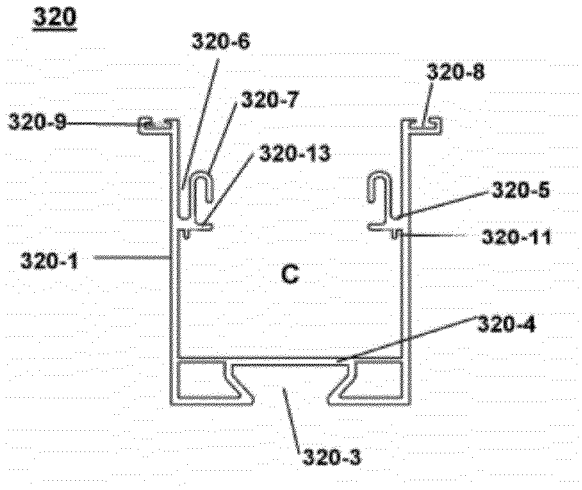
[Figure 17]
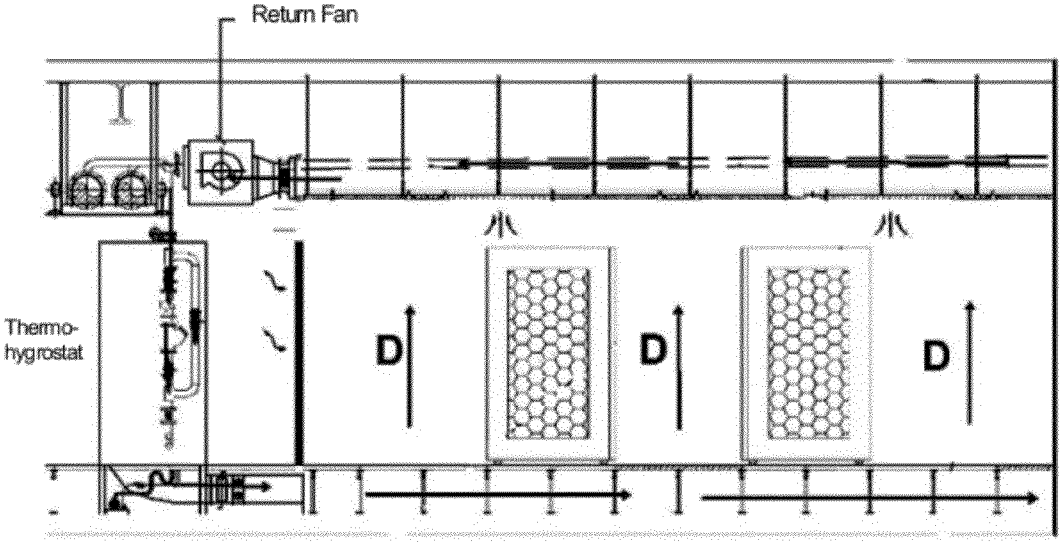

WATERPROOF CEILING

CROSS-REFERENCES TO RELATED APPLICATION

This patent application claims the benefit of priority under 35 U.S.C. §119 from Korean Patent Application No. 10-2009-0040637 filed on May, 11, 2009, the contents of which are incorporated herein by reference.

BACKGROUND OF THE INVENTION

1. Field of the Invention

The present invention relates generally to a waterproof ceiling and, more particularly, to a waterproof ceiling, which standardizes respective parts to enable the installation of multiple types of structures, avoids spatial restrictions when a pipe, wire, duct, tray and others are installed, and maximizes the circulation of air, thus preventing damage due to the water leakage from a ceiling at a place where expensive equipment is protected or confidential materials are secured.

2. Description of the Related Art

Currently, a lightweight ceiling steel frame for evenly arranging and supporting a ceiling finishing material, a T-BAR, an M-BAR, or a TH-BAR for attaching the finishing material, and a ceiling finishing material such as aluminum, a gypsum board, or Miton are used as the ceiling material of a general building.

Water leakage from a ceiling causes fatal damage to main equipment (server, precision equipment, medical equipment, electronic devices, etc.) and power equipment, and leads to secondary damage such as the loss of information resources, thus resulting in vast damage to property. Particularly, cooling and heating water pipes, fire extinguishing water pipes and other water pipes are installed inside the ceiling surface of a building. Thus, when water leaks from the water pipes in the ceiling of the same floor or an upper floor, the water may cause serious damage to equipment installed under the water pipes.

For example, due to the malfunction of the sprinklers of an upper floor (6F), which is two floors up from the computer room of a security corporation situated on the fourth floor, a flooding accident of the computer room occurred in the year 2000. This accident led to property damage which amounted to several tens of billions of won and the interruption of security exchange services. As is known from the example, the leakage of water or the malfunction of equipment can cause serious trouble related to information which is the main resource of an information society and the function of a building, for example, the server of a computer room, the computerized information of a bank, the power equipment of a building, and expensive medical equipment, thus causing damage to customers, members, and consumers.

In order to solve the problem and prevent the leakage of water, the construction work of removing the water pipes from the ceiling, installing a gas extinguishing system, and waterproofing the bottom of an upper floor has been performed. However, conducting the work is in most cases impossible because there are few cases where the upper floor is empty. Although waterproofing is possible, it is substantially impossible to prevent the leakage of water to a fan coil pipe, an outlet box and other gaps. Even if the passage of water to the fan coil pipe, outlet box and other gaps is prevented, it is difficult to get rid of water spread out broadly in a horizontal direction within a short period of time.

In order to solve the problem, Korean U.M. Registration No. 264930, which is entitled "Auxiliary Appliance for Detecting Water Leakage from Ceiling", has been proposed. The auxiliary appliance includes a plurality of waterproof assemblies joined together so as to prevent water from leaking out of the entire area of a ceiling. A hanger frame secures each waterproof assembly to the back of concrete while maintaining a predetermined space for installing equipment. A drain pipe is mounted to the side edge of each waterproof assembly to drain leaked water. A plurality of water leakage sensors is secured to each waterproof assembly at regular intervals, thus generating an electric detection signal when a predetermined amount of water is detected. An alarm unit is embedded in each waterproof assembly, and transmits a warning sound to a manager, in response to the detected signal. In order to waterproof a ceiling surface, auxiliary waterproofing materials are layered up.

However, the conventional waterproofed ceiling is problematic in that a plurality of waterproof reinforcing materials is layered in each waterproof assembly, so that the weight of the ceiling increases, thus making it difficult to construct and increasing construction cost. Further, this ceiling is problematic in that, when an excessive amount of water leaks from an upper ceiling, the ceiling surface does not bear the weight of water, so that the ceiling surface tends to be destroyed or sag down.

As another technology, Korean patent No. 10-0702847, which is entitled "Light-weight Double Ceiling Structure for Preventing Passage of Water and Dust", has been laid open. The double ceiling structure requires a two-stage height to install the structure in a ceiling, so that it is impossible to apply the double ceiling structure if there is no extra space in the ceiling. Further, the double ceiling structure is problematic in that a hanger unit passes through a waterproof ceiling surface, so that perfect waterproofing is limited, and it is impossible to check the interior of the ceiling after the double ceiling structure was constructed, and it is inconvenient to assemble and construct.

SUMMARY OF THE INVENTION

Accordingly, the present invention has been made keeping in mind the above problems occurring in the prior art, and an object of the present invention is to provide a waterproof ceiling, which standardizes respective parts to allow the parts to be easily assembled and installed, provides multiple types of structures to enable equipment such as a pipe, wire, duct, or tray to be easily arranged without regard to spatial limitations, and provides an additional space between an upper waterproof ceiling surface and a lower general ceiling surface to be utilized as the passage for air circulation, thus keeping the indoor environment pleasant.

In order to accomplish the above object, the present invention provides a waterproof ceiling, including a hanger unit which is secured at an upper end thereof to a predetermined portion of an existing ceiling to support load on a lower end, a carrying channel which is connected to the lower end of the hanger unit so as to be at right angles with the hanger unit, a drain module bar which is connected and secured to a predetermined portion on the carrying channel and forms a predetermined angle with the ground to create a flow passage for leaked water, a waterproof panel which is fitted to each of both sides of the drain module bar, thus closing a space between drain module bars, and a water collecting pipe which is provided horizontally on an end of the drain module bar, thus collecting the leaked water and discharging the water to an outside.

The hanger unit may include a hanger bolt which is connected to a concrete anchor secured to the ceiling wall or a puzzle anchor secured to a groove-shaped rail which is formed in the lower end of the drain module bar, and a suspending hanger which is connected to an end of the hanger bolt to support the carrying channel or the drain module bar at a lower position.

The drain module bar may include a sidewall which is bent at both ends thereof outwards and has at an upper end thereof a sealing groove so that a sealing member is inserted into the sealing groove, a fitting groove which is formed inside the sidewall such that each of both ends of the waterproof panel is fitted into the fitting groove, and a groove-shaped rail which is provided in an outer surface of a bottom closing off lower ends of both sides of the sidewall so that the puzzle anchor is inserted into the rail.

The drain module bar may further include a wing which protrudes from the lower end of each of both sides of the sidewall to allow a finishing member or a sound absorbing board to be fitted to the wing. The sound absorbing board can be made of textile or other materials, such as a gypsum, glass, or mixture thereof.

A stopper may be provided at a junction of the sidewall with the fitting groove, thus adjusting a depth to which each of both ends of the waterproof panel is inserted into the fitting groove. An inverted hanger provided at a position on the carrying channel or a module bar hanger secured to the hanger bolt connected to the carrying channel by the suspending hanger may be inserted into a hanger insert hole formed inside the sidewall of the drain module bar.

The drain module bar may be joined with a neighboring drain module bar by a module-bar fitting panel bent at both side ends thereof or an outer coupling bar formed to cover an outer portion of the drain module bar.

Further, the drain module bar may be joined with a neighboring drain module bar by a module-bar fitting panel bent at both side ends thereof or a module-bar joint panel fitted into a panel fitting part formed on an outer portion on each of upper and lower ends of the sidewall of the drain module bar. The drain module bar may form an angle from 0.3° to 2° with the ground.

The waterproof panel may include a lower waterproof panel having a fitting projection which extends downwards from each of both ends of the lower waterproof panel to be fitted into the fitting groove of the drain module bar and a connector which protrudes in a direction opposite to the fitting projection, an upper waterproof panel having a fitting projection which extends downwards from each of both ends of the lower waterproof panel to be fitted into the fitting groove of the drain module bar and a connector insert part which protrudes in a direction opposite to the fitting projection and is bent to receive the connector, and a horizontal waterproof panel closing off a space between neighboring drain module bars and allowing an additional member to be inserted into the horizontal waterproof panel.

The connector of the lower waterproof panel may be inserted into the connector insert part of the upper waterproof panel to provide a coupling part, thus preventing water collected in the waterproof panel from escaping out.

The puzzle anchor may be inserted into the rail formed in the lower end of the drain module bar to allow a hanger bolt to be connected thereto, and a channel part may be provided between hanger bolts to enable a tray, pipe or duct to be loaded thereon.

The hanger unit may be additionally inserted into the rail formed in the lower end of the drain module bar to allow a T-BAR, TH-BAR, M-BAR or module bar to be connected to an end of the hanger unit, and a finishing member may be installed between T-BARs, TH-BARs, M-BARs or module bars.

Further, hotter indoor air may circulate to a side through a space between the drain module bar and the finishing member, and air cooled by a thermo-hygrostat may be supplied through a bottom of a room into the room.

A sound absorbing board may be further provided on an inner surface of the finishing member to absorb noise. The T-BAR, TH-BAR, M-BAR or module bar may be connected to the carrying channel provided on an end of the hanger unit using a locking clip.

As described above, the present invention provides a waterproof ceiling, which is manufactured by assembling standardized parts, thus allowing a single-layered or multi-layered structure to be easily installed, allowing a broken part to be easily replaced with a new one, therefore reducing maintenance costs, and allowing equipment such as a pipe, wire, duct or tray to be arranged without regard to spatial restrictions. Further, the waterproof ceiling has multiple types of structures to secure an additional space which is utilized as the passage for air circulation, thus keeping the indoor environment pleasant, and allowing indoor air to be easily heated or cooled. Further, the waterproof ceiling prevents impurities including dust from entering a room, thus preventing precision equipment from being broken or damaged, in addition to keeping the indoor environment pleasant.

BRIEF DESCRIPTION OF THE DRAWINGS

FIG. 6 is an exploded perspective view of a base-type drain module bar;

FIG. 7 is a side sectional view illustrating the base-type drain module bar of FIG. 6;

FIG. 8 is a view illustrating the coupling of a waterproof panel according to the present invention;

FIG. 14 is a side sectional view of FIG. 13;

FIG. 15 is an exploded perspective view of an air conditioning-type drain module bar;

FIG. 16 is a side sectional view illustrating the air conditioning-type drain module bar of FIG. 15; and FIG. 17 is a view illustrating the use of the air conditioning-type waterproof ceiling.

DESCRIPTION OF THE PREFERRED EMBODIMENTS

The above and other objects, features and advantages of the present invention will be more clearly understood from the following detailed description taken in conjunction with the accompanying drawings. Hereinafter, waterproof ceiling according to various embodiments of the present invention will be described in detail with reference to the accompanying drawings. The terminologies used in the description and the claims of the present invention are widely used in the field of a construction material, and will be described in detail when necessary.

Figure 1:
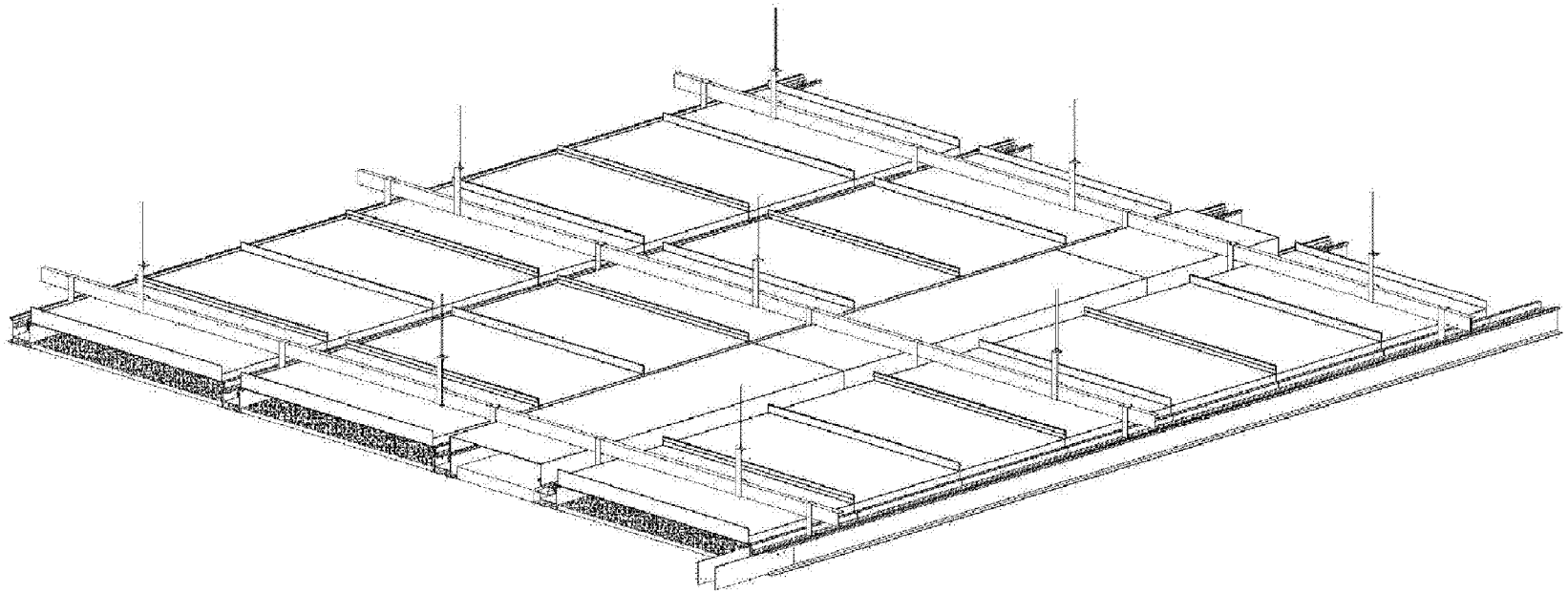
FIG. 1 is a perspective view illustrating a base-type waterproof ceiling according to the present invention.
Figure 2:
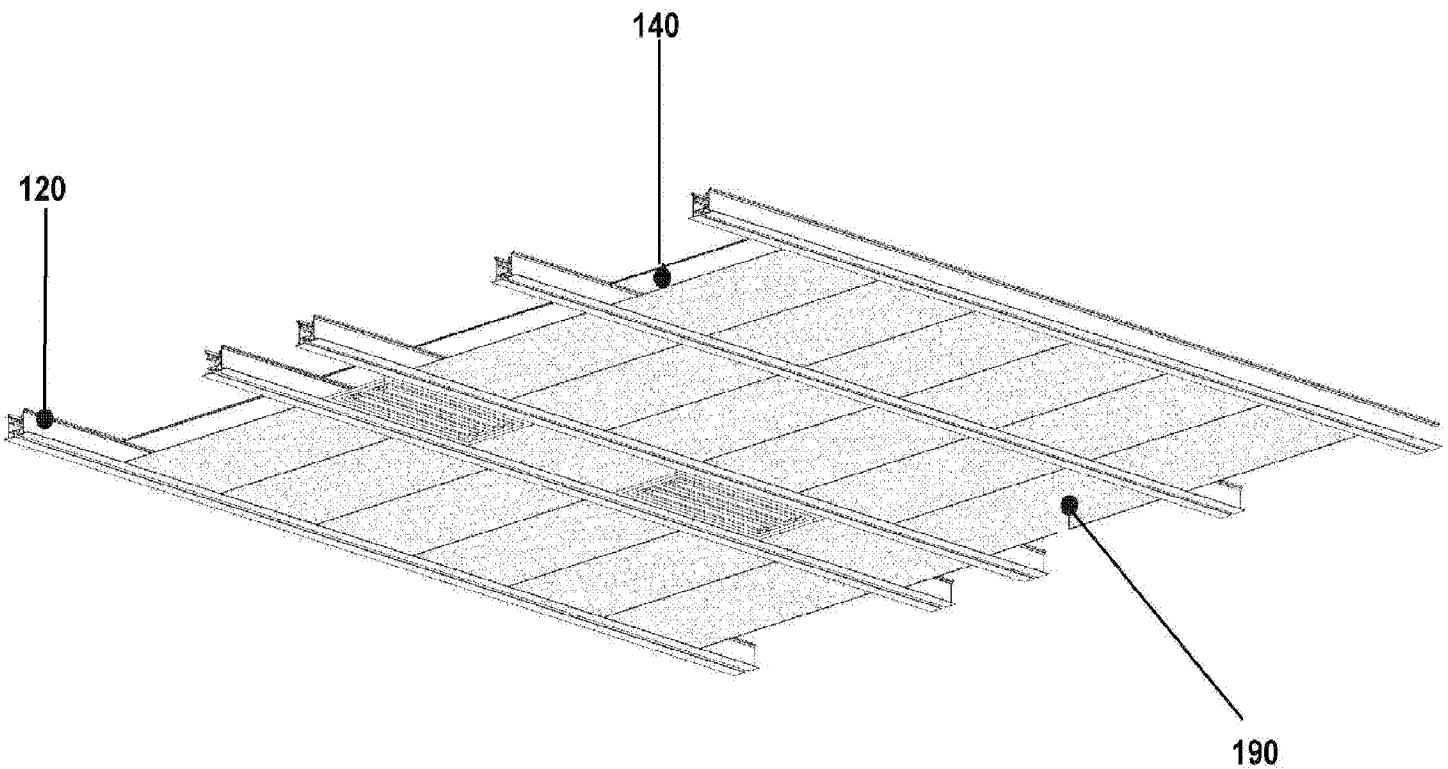
FIG. 2 is a partial bottom perspective view illustrating the base-type waterproof ceiling.
Figure 3:
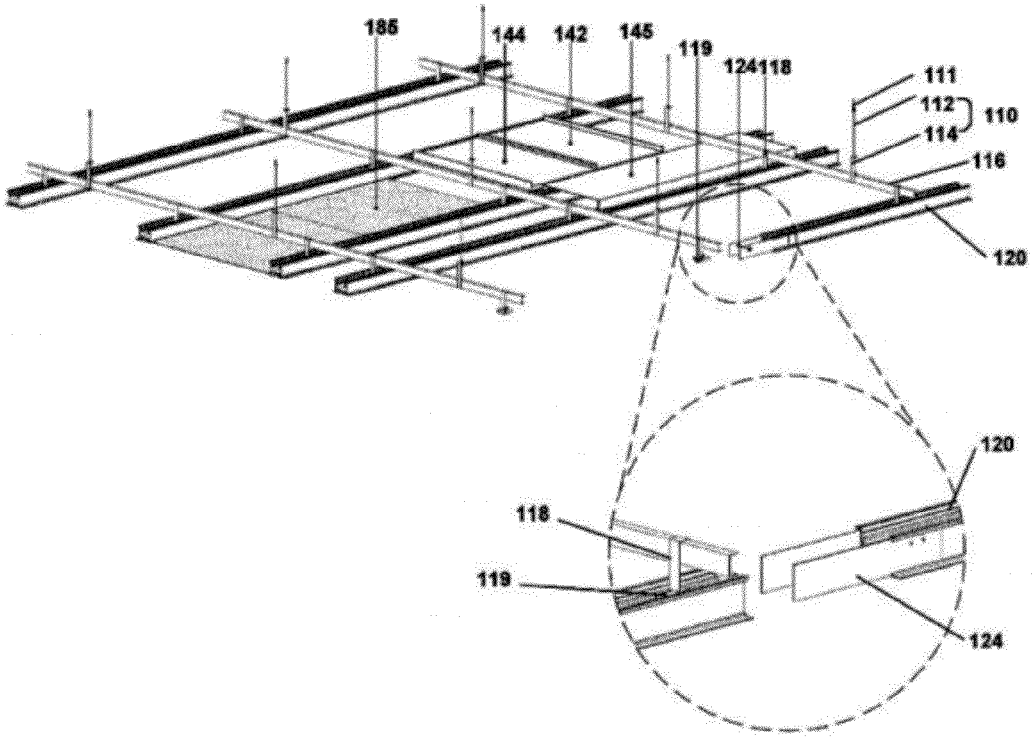
FIG. 3 is a partial top perspective view illustrating the base-type waterproof ceiling.
Figure 4:
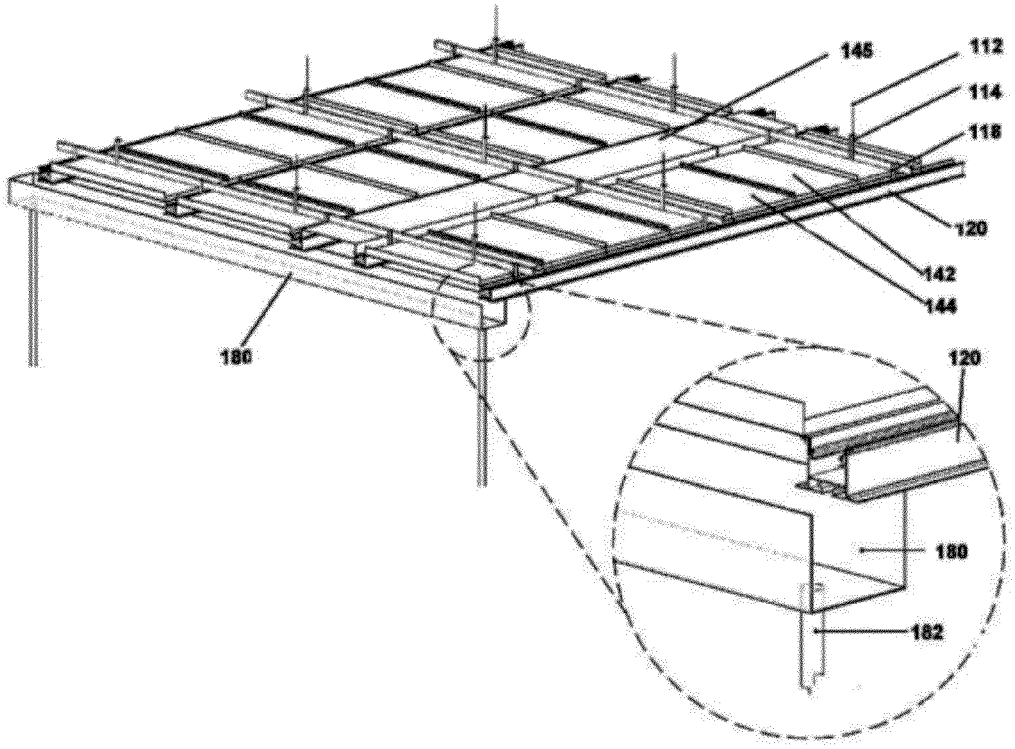
FIG. 4 is a partial top perspective view illustrating the base-type waterproof ceiling of FIG. 3 to which a water collecting pipe is added.
Figure 5:
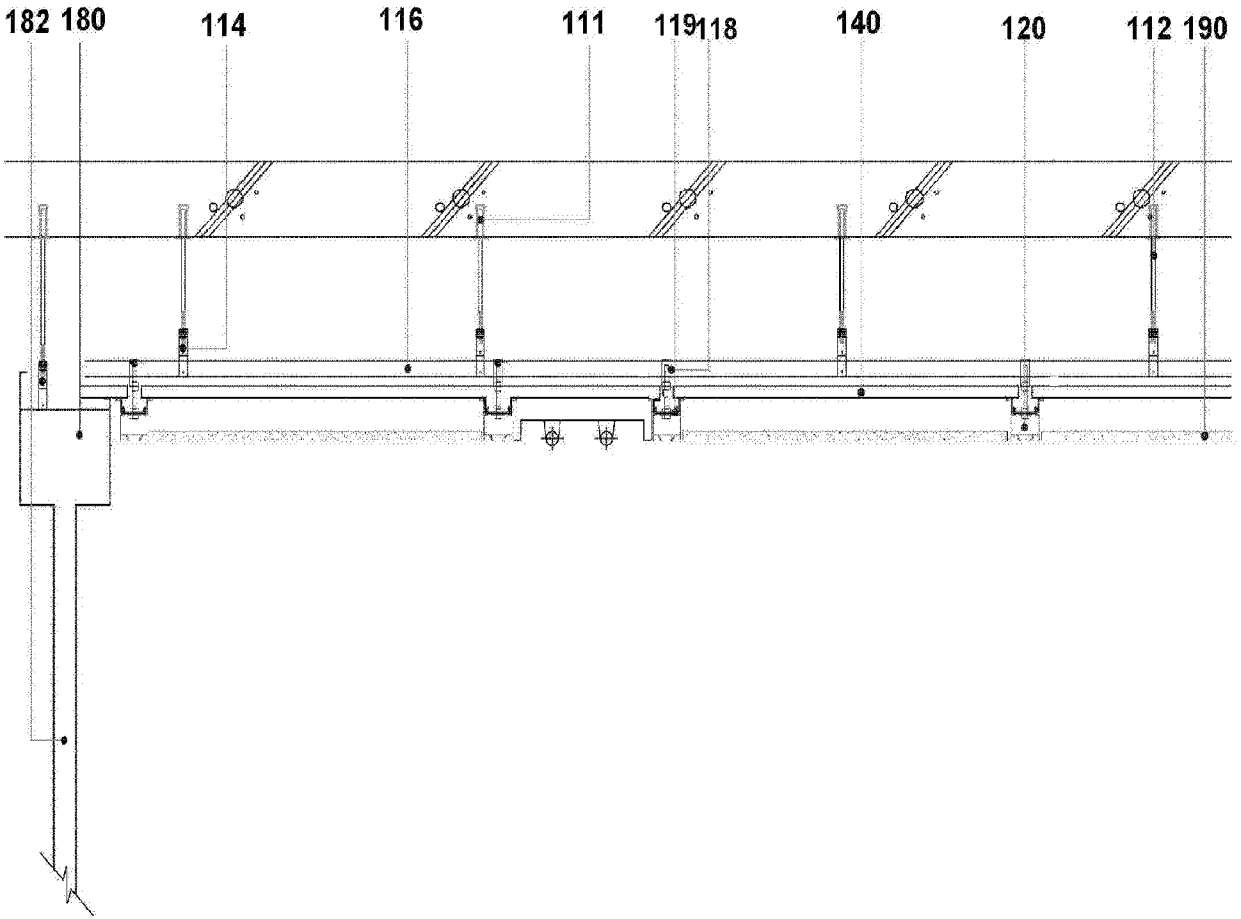
FIG. 5 is a side sectional view of FIG. 2.

FIG. 1 is a perspective view illustrating a base-type waterproof ceiling, which is one embodiment of a waterproof ceiling according to the present invention, FIG. 2 is a partial bottom perspective view illustrating the base-type waterproof ceiling, and FIG. 3 is a partial top perspective view illustrating the base-type waterproof ceiling. Further, FIG. 4 is a partial top perspective view illustrating the base-type waterproof ceiling of FIG. 3 to which a water collecting pipe is added, and FIG. 5 is a side sectional view of FIG. 2.

Referring to FIGS. 1 to 5, a base-type waterproof ceiling according to one embodiment of the present invention includes a hanger unit 110, a carrying channel 116, a base-type drain module bar 120, a waterproof panel 140, and a water collecting pipe 180. The hanger unit 110 is secured at an upper end thereof to a predetermined portion on a ceiling wall, and is placed perpendicularly to the ground to bear a load on the lower end applied by other ceiling parts. The carrying channel 116 is connected to the lower end of the hanger unit 110 and placed parallel to the ground in such a way as to be perpendicular to the hanger unit 110. The base-type drain module bar 120 is connected and secured to a portion on the carrying channel 116, and makes a predetermined angle with the ground to form the flow passage of water leaking from a ceiling. The waterproof panel 140 is fitted to each of both sides of the base-type drain module bar 120 and closes a space between neighboring drain module bars 120. The water collecting pipe 180 is provided vertically on one end of the base-type drain module bar 120, thus collecting the leaked water and discharging the leaked water to the outside.

The hanger unit 110 includes a hanger bolt 112 and a suspending hanger 114. The hanger bolt 112 is connected to a concrete anchor 111 secured to the ceiling wall. The suspending hanger 114 is connected to one end of the hanger bolt 112 so as to support the base-type drain module bar 120 under the suspending hanger 114. Here, the suspending hanger means a member which is bent to couple specific parts to each other.

FIG. 6 is an exploded perspective view of the base-type drain module bar 120, and FIG. 7 is a side sectional view illustrating the base-type drain module bar 120 of FIG. 6. The base-type drain module bar 120 of FIGS. 1 through 5 is shown in detail in FIGS. 6 and 7. Referring to the drawings, the base-type drain module bar 120 includes a sidewall 120-1, fitting grooves 120-6, and a rail 120-3. The sidewall 120-1 is bent at both ends thereof outwards, so that sealing grooves 120-8 are formed in the upper bent ends, thus permitting sealing members 120-9 to be inserted into the sealing grooves 120-8. The fitting grooves 120-6 are formed inside the sidewall 120-1 so that both ends of the waterproof panel 140 are fitted into the fitting grooves 120-6. The groove-shaped rail 120-3 is provided in the outer surface of a bottom 120-4 which closes the lower ends of both sides of the sidewall 120-1, so that an additional puzzle anchor is inserted into the groove-shaped rail 120-3. Further, the drain module bar 120 also includes wings 120-2 and stoppers 120-5. The wings 120-2 protrude from the lower ends of both sides of the sidewall 120-1 so that a finishing member 190 or a sound absorbing board 185 is fitted to each wing 120-2. The stopper 120-5 is provided at the junction of the sidewall 120-1 and the fitting groove 120-6.

Here, the stopper 120-5 can adjust a depth to which both ends of the waterproof panel 140 are inserted into the fitting grooves 120-6. That is, if each stopper 120-5 is provided at a deep position, both ends of the waterproof panel 140 may deeply enter the fitting grooves 120-6. On the other hand, if each stopper 120-5 is provided at a shallow position, the insert depth of both ends of the waterproof panel 140 is relatively small.

The base-type drain module bar 120 may be installed by inserting a module bar hanger 119 secured to an inverted hanger 118 provided at a position on the carrying channel 116 into hanger insert holes 120-7 formed inside the sidewall 120-1 of the base-type drain module bar 120. Here, the module bar hanger 119 is perpendicularly connected to the inverted hanger 118 and is almost parallel to the ground. Both ends of the module bar hanger 119 are bent to be easily inserted into the hanger insert holes 120-7. Support bars 120-13 are provided on the bottoms of the hanger insert holes 120-7, thus preventing both ends of the module bar hanger 119 from being easily removed from the hanger insert holes 120-7.

The finishing member 190 secured by the wings 120-2 of the base-type drain module bar 120 includes an aluminum ceiling plate, a gypsum board, Miton, synthetic resin, and others.

Referring to FIG. 6, a plurality of the base-type drain module bars 120 is joined together by a module-bar fitting panel 126 which is bent at both side ends, or a module-bar joint panel 124 inserted into panel fitting parts 120-10 formed in the outer portions on the upper and lower ends of the sidewall 120-1 of the base-type drain module bar 120. The module-bar fitting panel 126 serves to join the base-type drain module bars 120 with each other while supporting the inner space of each drain module bar 120. The module-bar joint panel 124 serves to join the base-type drain module bars 120 with each other while supporting each of both sides of the drain module bar 120.

The base-type drain module bar 120 is installed to form an angle from about 0.3° to 2° with the ground. The base-type drain module bar 120 is designed according to a place, size and construction to be waterproofed, thus allowing water leaking out of the ceiling to be rapidly discharged. The length and shape of the base-type drain module bar 120 may be changed according to the inner space in which the bar 120 is to be installed, as long as the leaked water is rapidly drained.

FIG. 8 is a view illustrating the coupling of the waterproof panel 140 according to the present invention. Referring to FIGS. 1 through 8, the waterproof panel 140 includes a lower waterproof panel 144, an upper waterproof panel 142, and a horizontal waterproof panel 145. The lower waterproof panel 144 includes fitting projections 146 which are provided on both ends of the panel 144 in such a way as to extend downwards and are fitted into the fitting grooves 120-6 of the base-type drain module bar 120, and connectors 149 which protrude upwards to be opposite to the fitting projections 146. The upper waterproof panel 142 includes fitting projections 146 which are provided on both ends of the panel 144 in such a way as to extend downwards and are fitted into the fitting grooves 120-6 of the base-type drain module bar 120, and connector insert parts 143 which protrude in the direction opposite to the fitting projections 146 and are bent to receive the connectors 149. The horizontal waterproof panel 145 closes a space between the base-type drain module bars 120, and permits an additional member to be inserted therein. Particularly, a coupling part 148, formed by inserting each connector 149 of the lower waterproof panel 144 into the connector insert part 143 of the upper waterproof panel 142, doubly prevents the leakage of water, thus preventing water gathered in the waterproof panel 140 from leaking out.

The fitting projection 146 is at right angles with the connector 149 or the connector insert part 143, and the connector 149 and the connector insert part 143 are parallel to each other. The coupling part 148 is formed and a space between the base-type drain module bars 120 is closed through continuous fitting.

Various materials including PVC, polycarbonate, and aluminum, coated materials having high waterproof effects, and combinations thereof may be used as the material of the waterproof panel 140.

The water leakage preventing function of the base-type waterproof ceiling illustrated in FIGS. 1 to 8 is as follows. That is, water leaking from the ceiling or water generated by the cohesion of steam generated due to a difference in temperature flows along the waterproof panel 140 to be gathered in the base-type drain module bar 120. After the water flows along the space A of FIG. 7 and is collected in the water collecting pipe 180 provided on an end of the drain module bar 120, the water is discharged to the outside through a drain pipe 182 provided at a predetermined position on the water collecting pipe 180.

In the course of the drainage, the leakage of water never occurs in gaps between respective parts of the waterproof panel 140, that is, the upper waterproof panel 142, the lower waterproof panel 144, and the horizontal waterproof panel 145. The water is forced to one side by the base-type drain module bar 120 which is inclined at a predetermined angle, preferably, 0.3° to 2°, and is easily guided to the outside.

An additional material is added to the base-type waterproof ceiling, thus providing an equipment-type waterproof ceiling or an air conditioning-type waterproof ceiling. Herein, the base-type structure means a general structure for finishing a ceiling without a specific function, and the equipment-type means a structure which is provided with equipment to provide a specific function to the base-type structure. Further, the air conditioning-type structure means a structure which has additional equipment to form flow passages for air.

Figure 9:
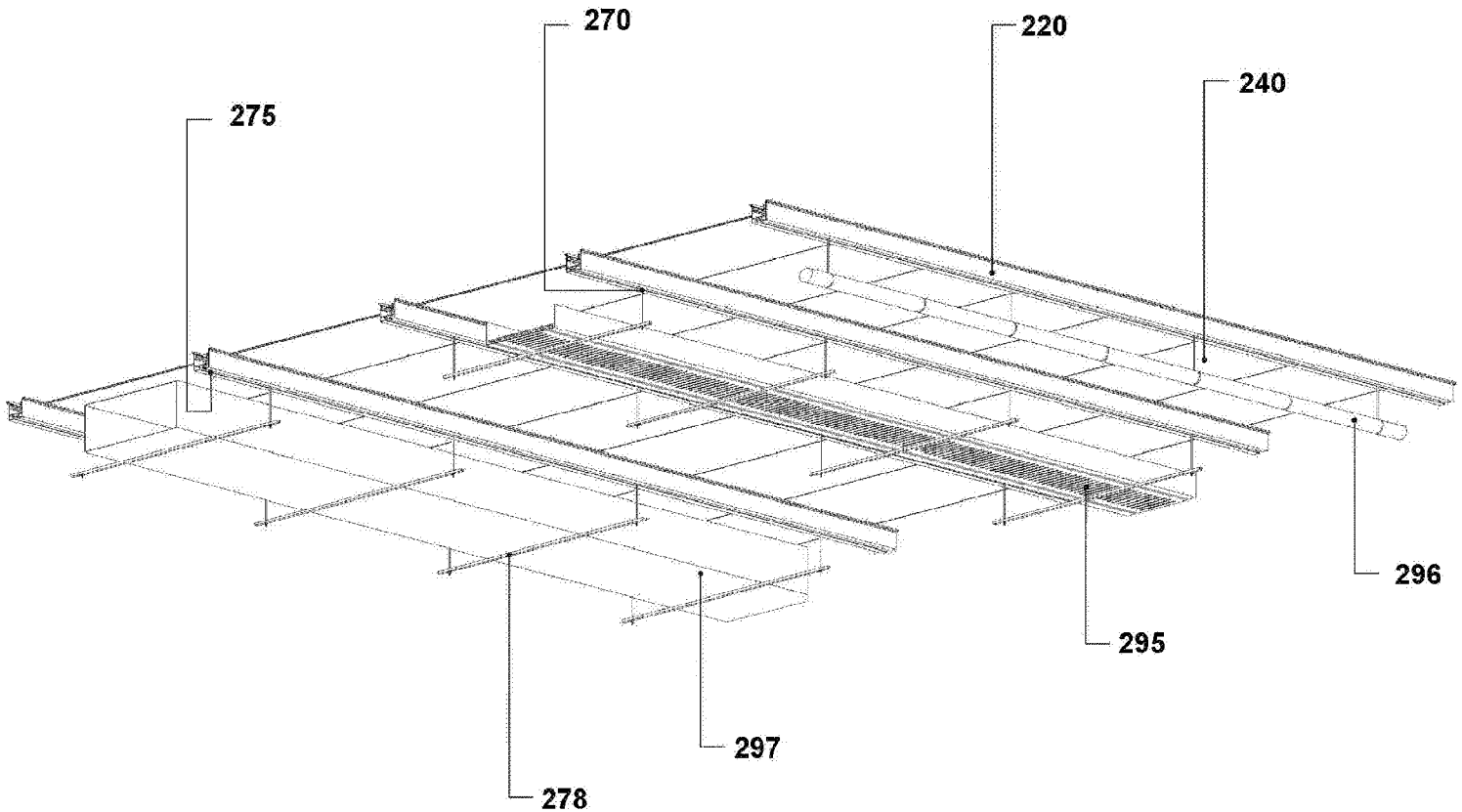
FIG. 9 is a partial perspective view illustrating an equipment-type waterproof ceiling, which is another embodiment of the waterproof ceiling according to the present invention.
Figure 10:
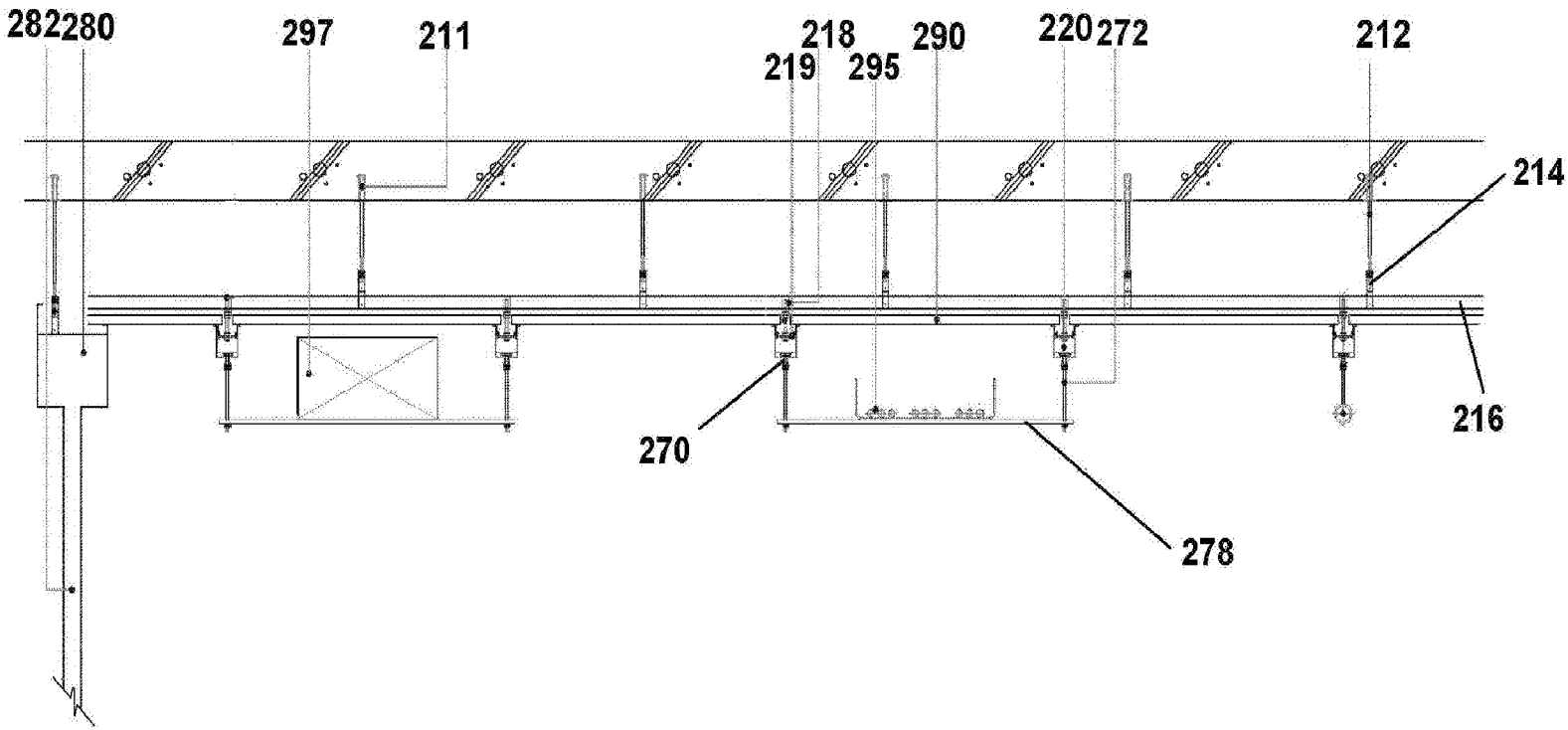
FIG. 10 is a side sectional view of FIG. 9.
Figure 11:
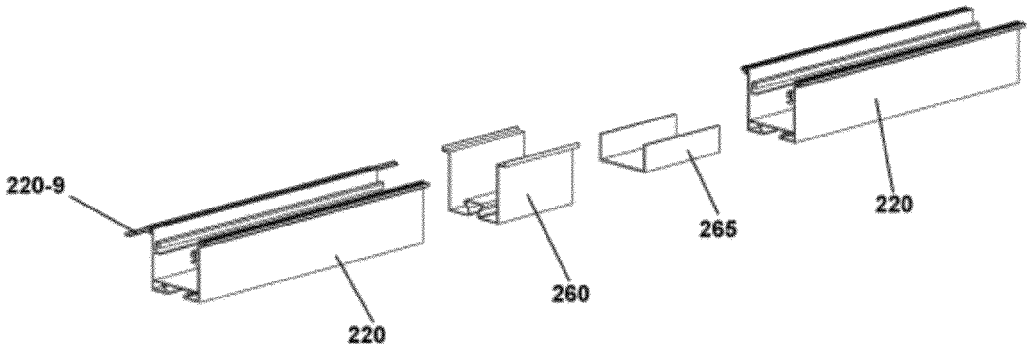
FIG. 11 is an exploded perspective view of an equipment-type drain module bar.
Figure 12:
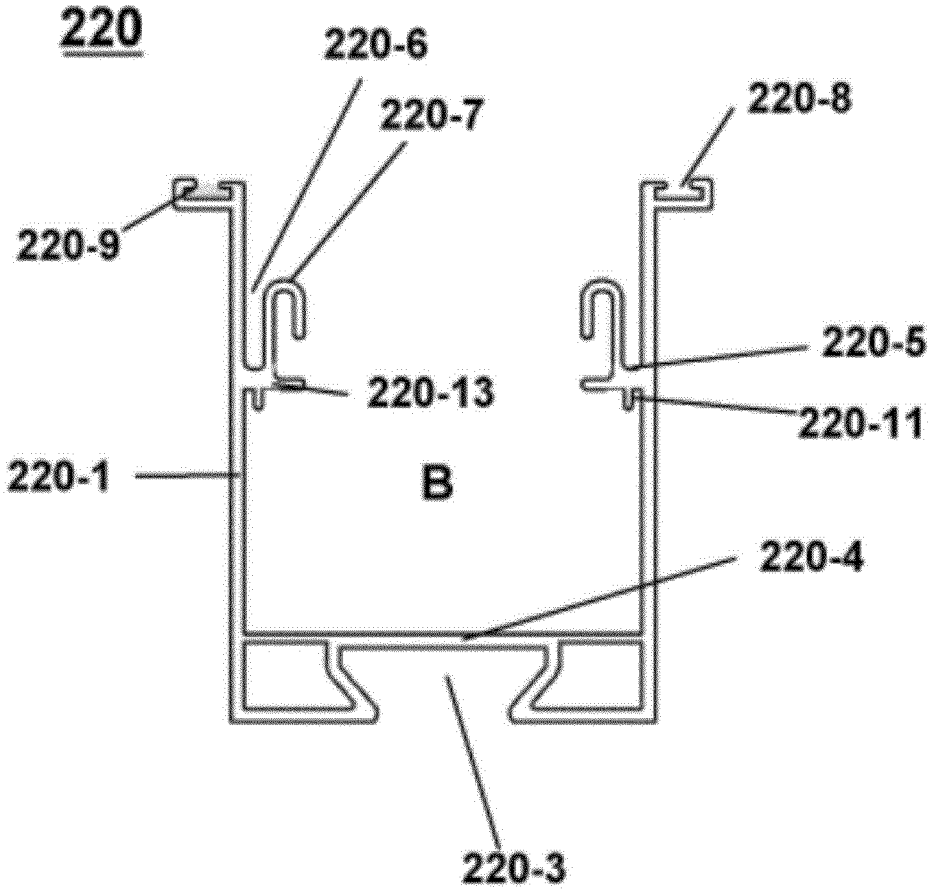
FIG. 12 is a side sectional view illustrating the equipment-type drain module bar of FIG. 11.

Hereinafter, the equipment-type waterproof ceiling will be described in detail. FIG. 9 is a partial perspective view illustrating an equipment-type waterproof ceiling according to another embodiment of the present invention, FIG. 10 is a side sectional view of FIG. 9, FIG. 11 is an exploded perspective view of an equipment-type drain module bar, and FIG. 12 is a side sectional view illustrating the equipment-type drain module bar of FIG. 11.

Referring to FIGS. 9 to 12, the equipment-type waterproof ceiling according to another embodiment of the present invention includes a hanger unit 210, a carrying channel 216, an equipment-type drain module bar 220, a waterproof panel 240, and a water collecting pipe 280. The hanger unit 210 is secured at an upper end thereof to a predetermined portion on a ceiling wall, and is placed perpendicularly to the ground to bear a load on the lower end applied by other ceiling parts. The carrying channel 216 is connected to the lower end of the hanger unit 210 and placed parallel to the ground in such a way as to be perpendicular to the hanger unit 210. The equipment-type drain module bar 220 is connected and secured to a portion on the carrying channel 216, and makes a predetermined angle with the ground to form the flow passage of water leaking from a ceiling. The waterproof panel 240 is fitted to each of both sides of the equipment-type drain module bar 220 and closes a space between neighboring drain module bars 220. The water collecting pipe 280 is provided vertically on one end of the equipment-type drain module bar 220, thus collecting the leaked water and discharging the leaked water to the outside. The water collected in the water collecting pipe 280 can be easily discharged through a drain pipe 282 to the outside.

The hanger unit 210 includes a hanger bolt 212 and a suspending hanger 214. The hanger bolt 212 is connected to a concrete anchor 211 secured to the ceiling wall. The suspending hanger 214 is connected to one end of the hanger bolt 212 so as to support the equipment-type drain module bar 220 under the suspending hanger 214. Here, the suspending hanger means a member which is bent to couple specific parts to each other.

The equipment-type drain module bar 220 includes a sidewall 220-1, fitting grooves 220-6, and a rail 220-3. The sidewall 220-1 is bent at both ends thereof outwards, so that sealing grooves 220-8 are formed in the upper bent ends, thus permitting sealing members 220-9 to be inserted into the sealing grooves 220-8. The fitting grooves 220-6 are formed inside the sidewall 220-1 so that both ends of the waterproof panel 240 are fitted into the fitting grooves 220-6. The groove-shaped rail 220-3 is provided in the outer surface of a bottom 220-4 which closes the lower ends of both sides of the sidewall 220-1, so that an additional puzzle anchor is inserted into the groove-shaped rail 220-3.

The equipment-type drain module bar 220 is different in shape from the above-mentioned base-type drain module bar 120. That is, when comparing FIGS. 6 and 7 with FIGS. 11 and 12, the base-type drain module bar 120 has the wings 120-2 to allow an additional finishing member to be mounted thereto, whereas the equipment-type drain module bar 220 has no wings. Further, in order to continuously join the base-type drain module bars 120 to each other, the module-bar fitting panel 126 and the module-bar joint panel 124 are provided. Especially, the module-bar joint panel 124 is fitted into the panel fitting part 120-10 formed on the end of the base-type drain module bar 120, thus allowing the base-type drain module bars 120 to be continuously joined together. In contrast, equipment-type drain module bars 220 are joined together by a module-bar fitting panel 265 which is bent at both sides and an outer coupling bar 260 which is formed to cover the outer portion of the drain module bar 220. That is, since the equipment-type drain module bar 220 has no wings, the equipment-type drain module bars 220 are continuously joined together using the outer coupling bar 260 which is formed to cover the outer portion of the equipment-type drain module bar 220. Except for that difference, the main parts of the equipment-type drain module bar 220, including the sealing members 220-9, the sealing grooves 220-8, the fitting grooves 220-6, the hanger insert holes 220-7, the support bars 220-13, the rail 220-3, the bottom 220-4, the panel fitting parts 220-11, and the stoppers 220-5 have the same function as the corresponding parts of the base-type drain module bar 120.

The equipment-type drain module bar 220 is installed to form an angle from about 0.3° to 2° with the ground. The equipment-type drain module bar 220 is designed according to a place, size and construction to be waterproofed, thus allowing water leaking out of the ceiling to be rapidly discharged. The length and shape of the equipment-type drain module bar 220 may be changed according to the inner space in which the bar 220 is to be installed, as long as the leaked water is rapidly drained.

Water leaking from the ceiling or water generated by the cohesion of steam generated due to a difference in temperature flows along the waterproof panel 240 to be gathered in the equipment-type drain module bar 220. After the water flows along the space B of FIG. 12 and is collected in the water collecting pipe 280 provided on an end of the drain module bar 220, the water is discharged to the outside through a drain pipe 282 provided at a predetermined position on the water collecting pipe 280.

Since the waterproof panel 240 used in the equipment-type waterproof ceiling has the same shape and function as the waterproof panel used in the base-type waterproof ceiling, the waterproof panel 240 will not be described herein.

In the equipment-type waterproof ceiling, a hanger bolt 272 is additionally connected to the rail 220-3 provided in the lower end of the equipment-type drain module bar 220, using a puzzle anchor 270, and a channel part 278 is provided between hanger bolts 272 to enable a tray 295, pipe or duct 297 to be additionally loaded thereon.

An additional construction material is installed to the equipment-type waterproof ceiling, thus providing the air conditioning-type waterproof ceiling having an air flow passage.

Figure 13:
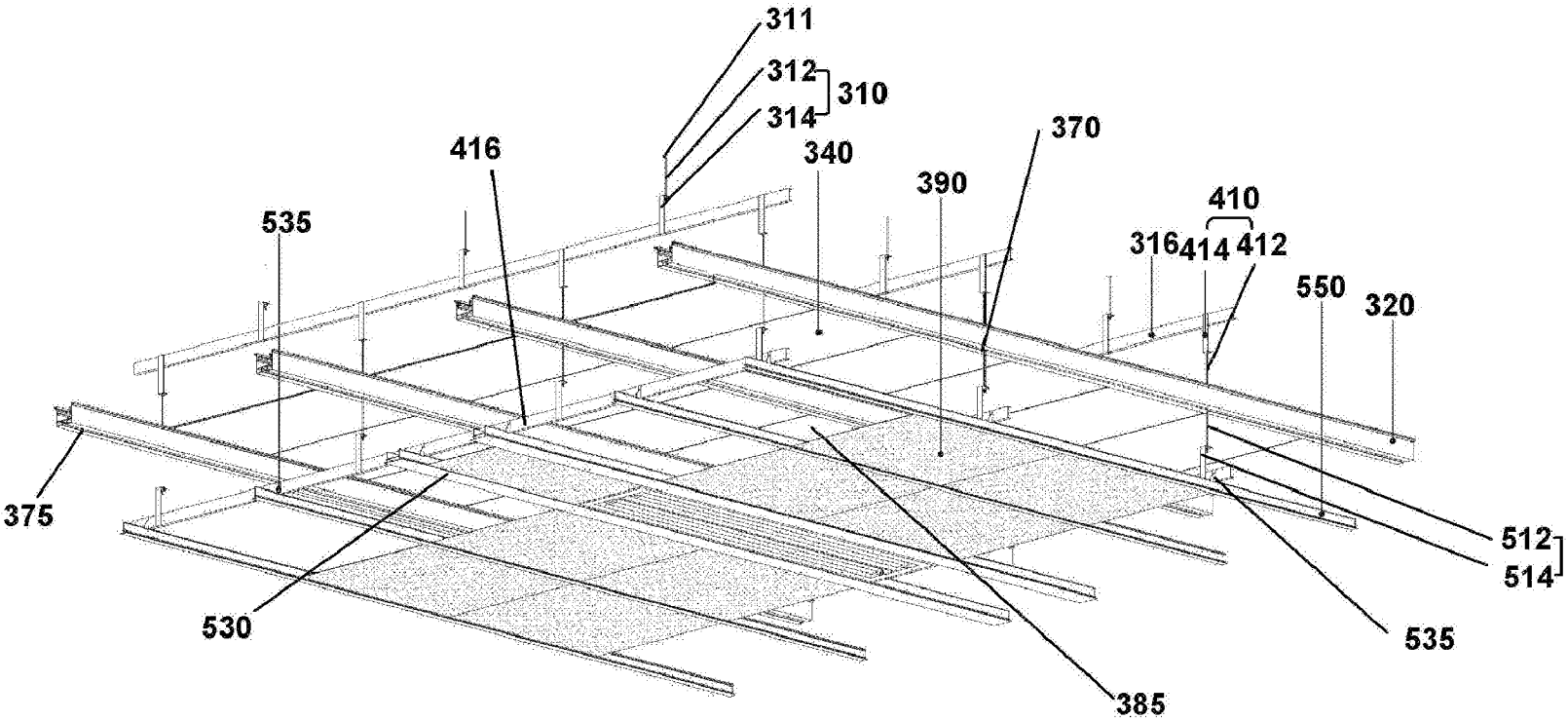
FIG. 13 is a partial perspective view illustrating an air conditioning-type waterproof ceiling, which is a further embodiment of the waterproof ceiling according to the present invention.

FIG. 13 is a partial perspective view illustrating an air conditioning-type waterproof ceiling, which is a further embodiment of the waterproof ceiling according to the present invention, FIG. 14 is a side sectional view of FIG. 13, FIG. 15 is an exploded perspective view of an air conditioning-type drain module bar, and FIG. 16 is a side sectional view illustrating the air conditioning-type drain module bar of FIG. 15.

Referring to FIGS. 13 to 16, the air conditioning-type waterproof ceiling which is a further embodiment of the waterproof ceiling according to the present invention includes hanger units 310, 410 and 510, carrying channels 316 and 416, an air conditioning-type drain module bar 320, a waterproof panel 340, and a water collecting pipe 380. Each hanger unit is secured at an upper end thereof to a predetermined portion on a ceiling wall or the waterproof ceiling, and is placed perpendicularly to the ground to bear a load on the lower end applied by other ceiling parts. The carrying channels 316 and 416 are connected, respectively, to the lower ends of the hanger units 310 and 510 and placed parallel to the ground in such a way as to be perpendicular to the hanger units 310 and 510. The air conditioning-type drain module bar 320 is connected and secured to a portion on each of the carrying channels 316 and 416, and makes a predetermined angle with the ground to form the flow passage of water leaking from a ceiling. The waterproof panel 340 is fitted to each of both sides of the air conditioning-type module bar 320 and closes a space between neighboring drain module bars 320. The water collecting pipe 380 is provided vertically on one end of the air conditioning-type drain module bar 320, thus collecting the leaked water and discharging the leaked water to the outside. The water collected in the water collecting pipe 380 can be easily discharged through a drain pipe 382 to the outside.

The first hanger unit 310 includes a first hanger bolt 312 and a first suspending hanger 314. The first hanger bolt 312 is connected to a concrete anchor 311 secured to the ceiling wall. The first suspending hanger 314 is connected to one end of the first hanger bolt 312 so as to support the first carrying channel 316 at a lower position. The second hanger unit 410 includes a second suspending hanger 414 and a second hanger bolt 412. The second suspending hanger 414 is secured to the first carrying channel 316. The second hanger bolt 412 is connected at one end thereof to the second suspending hanger 414 to support the air conditioning-type drain module bar 320 at a lower position. The third hanger unit 510 includes a third hanger bolt 512 and a third suspending hanger 514. The third hanger bolt 512 is connected to a puzzle anchor 370 secured to the rail 320-3 which is provided in the lower portion of the air conditioning-type drain module bar 320. The third suspending hanger 514 is connected to one end of the third hanger bolt 512 so as to support the second carrying channel 416 at a lower position.

As shown in FIGS. 15 and 16, air conditioning-type drain module bar 320 includes a sidewall 320-1, fitting grooves 320-6, and a rail 320-3. The sidewall 320-1 is bent at both ends thereof outwards, so that sealing grooves 320-8 are formed in the upper bent ends, thus permitting sealing members 320-9 to be inserted into the sealing grooves 320-8. The fitting grooves 320-6 are formed inside the sidewall 320-1 so that both ends of the waterproof panel 340 are fitted into the fitting grooves 320-6. The groove-shaped rail 320-3 is provided in the outer surface of a bottom 320-4 which closes the lower ends of both sides of the sidewall 320-1, so that the additional puzzle anchor 370 is inserted into the groove-shaped rail 320-3. The module bar hanger 319, secured to the second hanger bolt 412 connected to the first carrying channel 316 by the second suspending hanger 414, is inserted into the hanger insert holes 320-7 which are formed inside the sidewall 320-1.

Since the main parts of the air conditioning-type drain module bar 320 illustrated in FIGS. 15 and 16, including the sealing members 320-9, the sealing grooves 320-8, the fitting grooves 320-6, the hanger insert holes 320-7, the support bars 320-13, the rail 320-3, the bottom 320-4, the panel fitting parts 320-11, and the stoppers 320-5, have the same function and shape as the corresponding parts of the equipment-type drain module bar 220, the detailed description will be omitted herein. Similarly to the equipment-type drain module bar 220, air conditioning-type drain module bars 320 are joined together by a module-bar fitting panel 365 which is bent at both sides thereof or an outer coupling bar 360 which is formed to cover the appearance of the air conditioning-type drain module bar 320.

The air conditioning-type drain module bar 320 is installed to form an angle from about 0.3° to 2° with the ground. The air conditioning-type drain module bar 320 is designed according to a place, size and construction to be waterproofed, thus allowing water leaking out of the ceiling to be rapidly discharged. The length and shape of the air conditioning-type drain module bar 320 may be changed according to the inner space in which the bar 320 is to be installed, as long as the leaked water is rapidly drained.

Water leaking from the ceiling or water generated by the cohesion of steam generated due to a difference in temperature flows along the waterproof panel 340 to be gathered in the air conditioning-type drain module bar 320. After the water flows along the space C of FIG. 16 and is collected in the water collecting pipe 380 provided on an end of the drain module bar 320, the water is discharged to the outside through a drain pipe 382 provided at a predetermined position on the water collecting pipe 380.

Since the waterproof panel 340 used in the air conditioning-type waterproof ceiling has the same shape and function as the waterproof panel used in the equipment- or base-type waterproof ceiling, the waterproof panel 340 will not be described herein.

In the case of the air conditioning-type waterproof ceiling, the third hanger unit 510 having the third hanger bolt 512 and the third suspending hanger 514 is additionally inserted into the rail 320-3 which is provided in the lower surface of the air conditioning-type drain module bar 320, a T-BAR, TH-BAR, M-BAR 550 or module bar 530 is connected to an end of the third hanger unit 510, and a finishing member 390 is installed between T-BARs, TH-BARs, M-BARs 550 or module bars 530. Here, a sound absorbing board 385 may be further provided on the inner surface of the finishing member 390 to absorb noise.

The T-BAR, TH-BAR, M-BAR 550 or module bar 530 is connected to the second carrying channel 416 provided on an end of the third hanger unit 510 by the locking clip 535.

FIG. 17 is a view illustrating the use of the air conditioning-type waterproof ceiling. In the course D of FIG. 17, air heated by an indoor device circulates through a space between the finishing member 390 and the air conditioning-type drain module bar 320 in the air conditioning-type waterproof ceiling. The heated air flows to a side by an additional suction pump, and is cooled by a thermo-hygrostat connected to the pump. The cooled air is supplied to a room through an additional hole formed in the bottom of the room. The circulation of air along the course D is repeated, thus keeping the indoor environment pleasant.

By changing the positions where the air conditioning-type drain module bar 320 and the finishing member 390 are installed, the length of the course over which the air flows can be increased or reduced.

As described above, the present invention provides a waterproof ceiling including a base-type, an equipment-type and an air conditioning-type structures, which is manufactured by assembling standardized parts, thus allowing a single-layered or multi-layered structure to be easily installed, allowing a broken part to be easily replaced with a new one, and allowing equipment such as a wire, a drain duct or a gas pipe to be arranged without regard to spatial restrictions. Further, the waterproof ceiling provides multiple types of structures to secure an additional space for smooth circulation of air, thus keeping the indoor environment pleasant, and allowing indoor air to be easily heated or cooled. Further, the waterproof ceiling prevents dust from entering a room, thus providing reliable indoor environment (computer environment).

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A waterproof ceiling comprising:

a hanger unit securable at an upper end thereof to a predetermined portion of an existing ceiling to support a load on a lower end of the hanger unit;

a carrying channel connected to the lower end of the hanger unit so as to be at right angles with the hanger unit;

a drain module bar connected and secured to a predetermined portion on the carrying channel, forming a predetermined angle to create a flow passage for leaked water;

a waterproof panel fitted to each of both sides of the drain module bar, thus closing a space between drain module bars; and a water collecting pipe provided horizontally on an end of the drain module bar, thus collecting the leaked water and discharging the leaked water to an outside, wherein the drain module bar comprises: a sidewall bent at both ends thereof outwards, and having at an upper end thereof a sealing groove so that a sealing member is inserted into the sealing groove; a fitting groove formed inside the sidewall such that each of both ends of the waterproof panel is fitted into the fitting groove; and a groove-shaped rail provided in an outer surface of a bottom closing off lower ends of both sides of the sidewall so that a puzzle anchor can be inserted into the rail.

2. The waterproof ceiling as set forth in claim 1, wherein the hanger unit comprises:

a hanger bolt which is connectable to a concrete anchor secured to the ceiling wall; and a suspending hanger connected at a first end to an end of the hanger bolt opposite the concrete anchor at a second end to the carrying channel.

3. The waterproof ceiling as set forth in claim 1, wherein the drain module bar further comprises:

a wing protruding from the lower end of each of both sides of the sidewall to allow a finishing member or a sound absorbing board to be fitted to the wing.

4. The waterproof ceiling as set forth in claim 1, wherein the sound absorbing board is made of textile a gypsum, glass, or mixture thereof.

5. The waterproof ceiling as set forth in claim 1, wherein a stopper is provided at a junction of the sidewall with the fitting groove, thus adjusting a depth to which each of both ends of the waterproof panel is inserted into the fitting groove.

6. The waterproof ceiling as set forth in claim 1, wherein an inverted hanger provided at a position on the carrying channel or a module bar hanger secured to the hanger bolt connected to the carrying channel by the suspending hanger is inserted into a hanger insert hole formed inside the sidewall of the drain module bar.

7. The waterproof ceiling as set forth in claim 1, wherein the drain module bar is joined with a neighboring drain module bar by a module-bar fitting panel bent at both side ends thereof or an outer coupling bar formed to cover an outer portion of the drain module bar.

8. The waterproof ceiling as set forth in claim 1, wherein the drain module bar forms an angle from 0.3° to 2° with the ground.

9. The waterproof ceiling as set forth in claim 1, wherein the waterproof panel comprises:

a lower waterproof panel having a fitting projection which extends downwards from each of both ends of the lower waterproof panel to be fitted into the fitting groove of the drain module bar, and a connector which protrudes in a direction opposite to the fitting projection;

an upper waterproof panel having a fitting projection which extends downwards from each of both ends of the lower waterproof panel to be fitted into the fitting groove of the drain module bar, and a connector insert part which protrudes in a direction opposite to the fitting projection and is bent to receive the connector; and a horizontal waterproof panel closing off a space between neighboring drain module bars, and allowing an additional member to be inserted into the horizontal waterproof panel.

10. The waterproof ceiling as set forth in claim 9, wherein the connector of the lower waterproof panel is inserted into the connector insert part of the upper waterproof panel to provide a coupling part, thus preventing water collected in the waterproof panel from escaping out.

11. The waterproof ceiling as set forth in claim 2, wherein the puzzle anchor is inserted into the rail to allow the hanger bolt to be connected thereto, and a channel part is provided between hanger bolts to enable a tray, pipe or duct to be loaded thereon.

12. The waterproof ceiling as set forth in claim 1, wherein another hanger unit is inserted into the rail formed in the lower end of the drain module bar to allow a T-BAR, TH-BAR, M-BAR or module bar to be connected to an end of the another hanger unit, and a finishing member is installed between T-BARs, TH-BARs, M-BARs or module bars.

13. The waterproof ceiling as set forth in claim 12, wherein hotter indoor air circulates to a side through a space between the drain module bar and the finishing member, and air cooled by a thermo-hygrostat is supplied through a bottom of a room into the room.

14. The waterproof ceiling as set forth in claim 12, wherein a sound absorbing board is further provided on an inner surface of the finishing member to absorb noise.

15. The waterproof ceiling as set forth in claim 12, wherein the T-BAR, TH-BAR, M-BAR or module bar is connected to the carrying channel provided on an end of the another hanger unit using a locking clip.

* * * * *